US006273177B1

(12) United States Patent
Pleschiutschnigg

(10) Patent No.: US 6,273,177 B1
(45) Date of Patent: Aug. 14, 2001

(54) CONTINUOUS CASTING MOULD

(75) Inventor: Fritz-Peter Pleschiutschnigg, Duisburg (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/147,994

(22) PCT Filed: Sep. 20, 1997

(86) PCT No.: PCT/EP97/05164

§ 371 Date: Jun. 12, 2000

§ 102(e) Date: Jun. 12, 2000

(87) PCT Pub. No.: WO98/13157

PCT Pub. Date: Apr. 2, 1998

(30) Foreign Application Priority Data

Sep. 25, 1996 (DE) ..... 196 39 295

(51) Int. Cl.[7] ..... B22D 11/00; B22D 11/124

(52) U.S. Cl. ..... 164/418; 164/443; 164/459; 164/485

(58) Field of Search ..... 164/418, 443, 164/459, 485

(56) References Cited

U.S. PATENT DOCUMENTS

| | | | | |
|---|---|---|---|---|
| 3,511,305 | * | 5/1970 | Wertli | 164/485 |
| 3,595,302 | * | 7/1971 | Mallener | 164/283 |
| 3,763,920 | * | 10/1973 | Auman et al. | 164/82 |
| 3,837,391 | | 9/1974 | Rossi . | |
| 4,009,749 | * | 3/1977 | Alberny | 164/147 |
| 4,579,165 | * | 4/1986 | Kamel et al. | 164/418 |
| 5,513,691 | * | 5/1996 | Langner et al. | 164/418 |

FOREIGN PATENT DOCUMENTS

| | | | | |
|---|---|---|---|---|
| 0149734 | | 7/1985 | (EP) . | |
| 1282943 | | 3/1961 | (FR) . | |
| 2112384 | * | 10/1971 | (FR) . | |
| 2112384 | | 6/1972 | (FR) . | |
| 0011537 A1 | * | 10/1979 | (FR) . | |
| 2459093 | * | 1/1981 | (FR) . | |
| 57-22852 | * | 2/1982 | (JP) . | |
| 57-50251 | * | 3/1982 | (JP) . | |
| 2-104444 | * | 4/1990 | (JP) | 164/418 |
| 9521036 | | 8/1995 | (WO) . | |
| 9743063 | | 11/1997 | (WO) . | |

OTHER PUBLICATIONS

Patent Abstracts of Japan, vol. 010, No. 388 (M–549) , Dec. 25, 1986 & JP 61 176444 A (Sumitomo Heavy Ind Ltd) , Aug. 8, 1986.

Patent Abstracts of Japan, vol. 009, No. 158 (M–393) , Jul. 3, 1985 & JP 60 033854 A (Mitsubishi Jukogyo KK) , Feb. 21, 1985.

* cited by examiner

*Primary Examiner*—Nam Nguyen
*Assistant Examiner*—Emmanuel S. Luk
(74) *Attorney, Agent, or Firm*—Friedrich Kueffner

(57) ABSTRACT

A continuous casting mold for casting strands, preferably of steel, includes mold plates and water boxes, and a connecting plate for connecting each mold plate to one of the water boxes. A water cooling system is formed by water conduits between the mold plates and the water boxes, wherein the water conduits are arranged in a side of the water box facing the mold plate and not in the mold plate. The water box and the connecting plate of the water box are joined together by connecting screws and nuts, wherein the connecting screws are arranged in the mold plate and the nuts are arranged on the water box. The connecting screws have internal cooling ducts and the internal cooling ducts are connected to the water conduits.

8 Claims, 3 Drawing Sheets

CONTINUOUS CASTING MOULD

BACKGROUND OF THE INVENTION

1. Field of the Invention

The invention relates to a continuous casting mold for casting strands, preferably of steel, composed of mold plates and water boxes which are connected to each other and between which a water cooling system is constructed by means of water conduits, wherein the water conduits are arranged in the side of the water box facing the mold plate and not in the mold plate.

2. Description of the Related Art

Mold plates—preferably composed of copper for continuously casting slabs, thin slabs, blooms and sections—are cooled on the rear side thereof with water and are screwed onto a steel water box.

For example, in thin slab molds, the water is conducted through conduits having a width of about 5 mm from the outlet of the mold (bottom) vertically in the direction of the casting meniscus toward the upper edge of the mold. The water is conducted with a pressure of between 5 and 15 bars and flow velocities of 5 to 15 m/s through the water conduits in order to be able to absorb and convey away the thermalflux of up to 4 $MW/m^2$ at the phase boundary copper/water without an interference of the heat transfer by the formation of bubbles.

As a rule, these water conduits are worked into the copper plate on the side of the copper plate facing the water. This is done in mechanical workshops with NC-controlled machine tools which require a lot of time for this work and are very expensive.

It must also be noted that, especially in the case of thin slabs, molds according to DE 34 00 220 C2—with a concave shape on the side facing the steel or a convex shape on the side facing the water—the manufacture of water conduits requires more complicated machinery and higher costs than is the case in copper plates which have flat parallel sides and which are used in conventional slab molds.

In addition, in view of the service life of the copper plates which are to be considered wear parts, the provision of the water conduits is not useful economically.

Japanese document JP-A-61 146 444 shows a mold plate for the continuous casting of strands composed of steel. The mold plate is of sandwich construction and is composed of a copper plate for guiding the cast strand, wherein the copper plate is in connection with a support plate through a screw connection. Water conduits are arranged in the support plate. For connecting the copper plate to the support plate, increased thickness portions are provided on the side of the copper plate facing the support plate which engage in corresponding indentations in the support plate. Screws for tightly connecting the copper plate and the support plate are screwed into the increased thickness portions. The water conduits are arranged in the support plate and not in the copper plate.

A copper plate in sandwich construction is shown in PCT document WO-A-9521036, particularly FIG. 11. A copper plate on which the cast strand is guided is located on a steel plate. Cooling conduits are arranged in the steel plate and not in the copper plate. The cooling conduits are covered by the copper plate and the connection between the steel plate and the copper plate is effected by means of a screw connection. Sealing between the steel plate and the copper plate is effected by means of soft solder.

SUMMARY OF THE INVENTION

Starting from the prior art mentioned above, it is the object of the invention to find a technically more useful solution which makes it possible to construct the copper plates, which are to be considered wear parts, in a simpler and less expensive manner, and particularly to optimize the connection of the copper plate to the water box of steel;

The invention is characterized by a configuration of the continuous casting mold in which the water box and the connecting plate of the water box are joined together by means of screws which are placed in the mold plate and by means of nuts arranged on the water box and in which the connecting screws are provided with internal cooling ducts which are connected to the water conduits.

BRIEF DESCRIPTION OF THE DRAWING

FIG. 1: illustration of a long side mold plate with water box for casting thin slabs as a horizontal sectional view in the upper half of the mold;

FIG. 2: illustration of the mold plate as in FIG. 1, however, with a connecting plate in sandwich construction;

DESCRIPTION OF THE PREFERRED EMBODIMENTS

Figure 1:
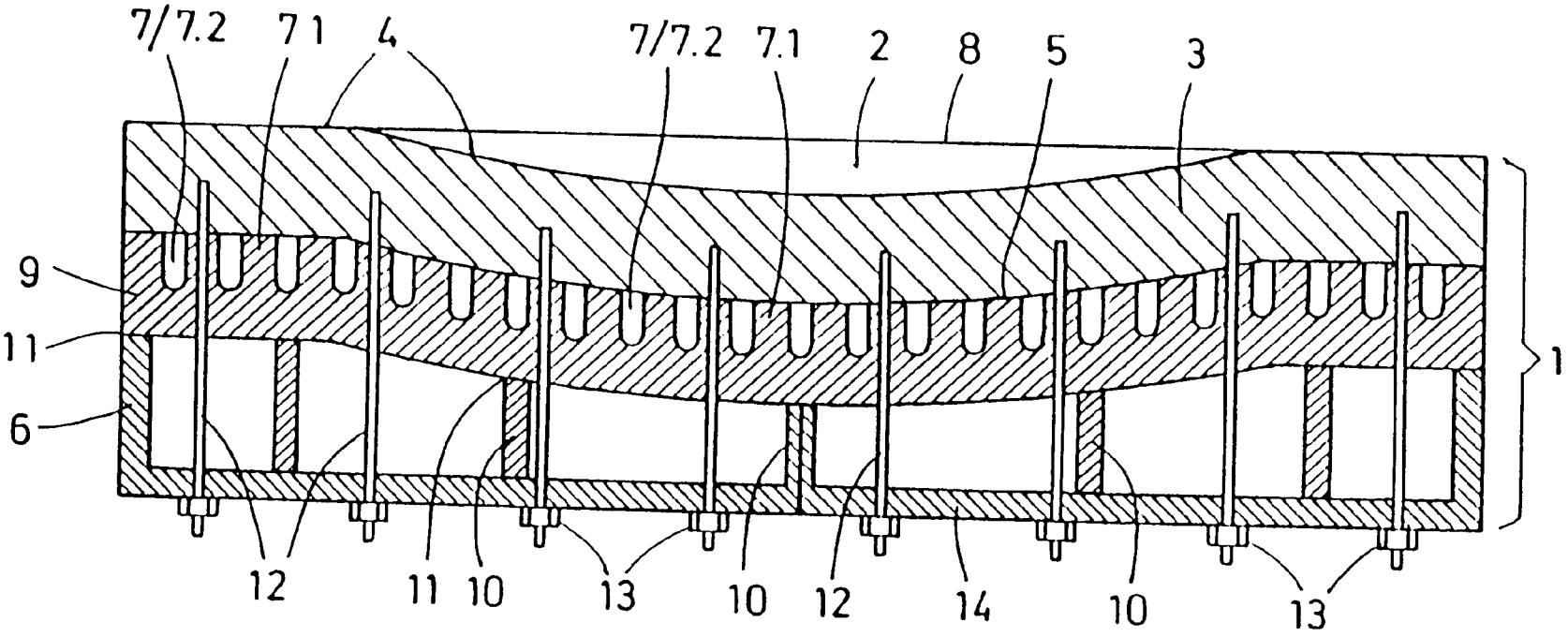
FIG. 1 and FIG. 2 serve to illustrate the following description of an example of the invention.

FIG. 1 is a horizontal sectional view of the long side 1 of a thin slab mold with casting funnel 2 or with a concave mold shape facing the liquid steel.

The long side of the mold is composed of

- a copper plate 3 with dimensions of, for example, 1.6×1.2 m and a thickness of 0.02 m, and which on both sides has smooth and parallel surfaces 4 and 5,
- a steel water box 6 which is provided with cooling water conduits 7 which follow the convex profile 5 of the copper plate 2 in the horizontal and vertical directions to the mold outlet 8.

The water box 6 is composed of a steel plate 9 which is provided with the water conduits 7, a wall thickness or comb thickness 7.1 and a conduit width 7.2, and the actual water conducting box with its webs 10.

The webs 10 can either be welded 11 to the steel plate 9 or may be connected, for example, by means of screws 12 which are placed in the long side copper plate 3, wherein the screws 12 are braced, for example, through nuts 13 or wedges provided with tongues to the rear side 14 of the water box.

Of course, the arrangement is also applicable to mold plates with flat parallel sides of conventional slab molds and to bloom molds and molds for sections, for example, dogbones or similar continuous casting shapes.

The advantages of the invention are a structural simplification of the wear part "copper" plate and the shifting of the "intelligent" (regulatable or controllable) portion of the mold with its water conduits 7 on the non-wearing mold part of the steel water box 6 with its steel plate 9.

Additional advantages are to be seen in that the anchor screws 12 do not have to be placed in the copper plate 3 as deeply for the necessary force transmission, because the water conduits are provided in the steel plate 9 of the steel water box 6 and not in the copper plate 3.

Consequently, the copper plate blank may be thinner and/or the copper plate thickness may be smaller, or the service life of the copper plate can be increased over more work cycles, so that additionally the material procuring costs can be lowered to a remarkable extent.

In addition, the solution of the invention provides the possibility that the water conduits 7 can be wider because of the better material properties of the steel as compared to copper, so that a better and more uniform cooling of the copper plate 3 is ensured.

In the past, the water ducts in the copper had a width of 5 mm and a comb thickness of 5 mm and, thus, resulted in a water coverage of 50%. A higher water coverage, i.e., a lower relative comb thickness 7.1, can be achieved with the material steel in the steel plate 9 of the water box because the danger of buckling of the steel comb 7.1 is substantially lower because of the lower thermomechanical load, on the one hand, and the higher mechanical load bearing capability of steel, on the other hand. Thus, the water conduit width 7.1 may be, for example, 16 mm and the comb thickness 4 mm. This arrangement would lead to a water coverage of 80% which, in turn, leads to an improved and more uniform cooling, and which makes it possible to reduce the cooling water velocities and/or the cooling water pressure.

A reduction of the cooling water pressure, in turn, would permit thinner copper plate thicknesses because the danger of buckling of the copper plate 3 or of the copper plate surface is smaller because of the reduced water pressure. The smaller copper plate thickness, in turn, leads to lower surface temperatures in the side 4 or hot face of the copper plate 3 which faces the liquid steel; this increases the service life of the copper plate.

Figure 2:
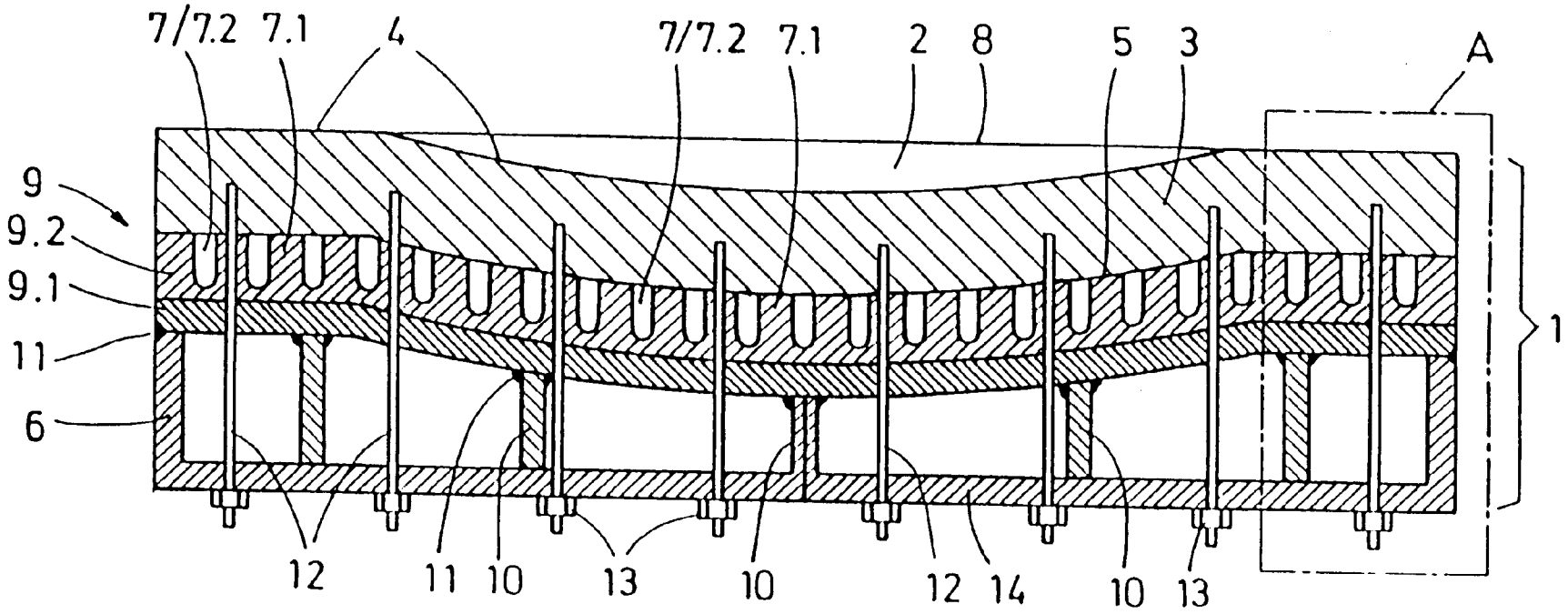

FIG. 2 refers with all essential features and advantages to FIG. 1 with the difference that the connecting plate 9 is not of steel but is constructed of a sandwich plate in such a way that an intermediate plate 9.2 of copper or a copper alloy is placed on the steel plate 9.1 of the water box 6, wherein the water conduits 7 are arranged in the intermediate plate 9.2. The intermediate plate 9.2 is braced by means of the tensioning screws 12 between the mold plate 3 and the water box 6 in such a way that no disadvantages can occur with respect to the heat transfer.

Figure 3:
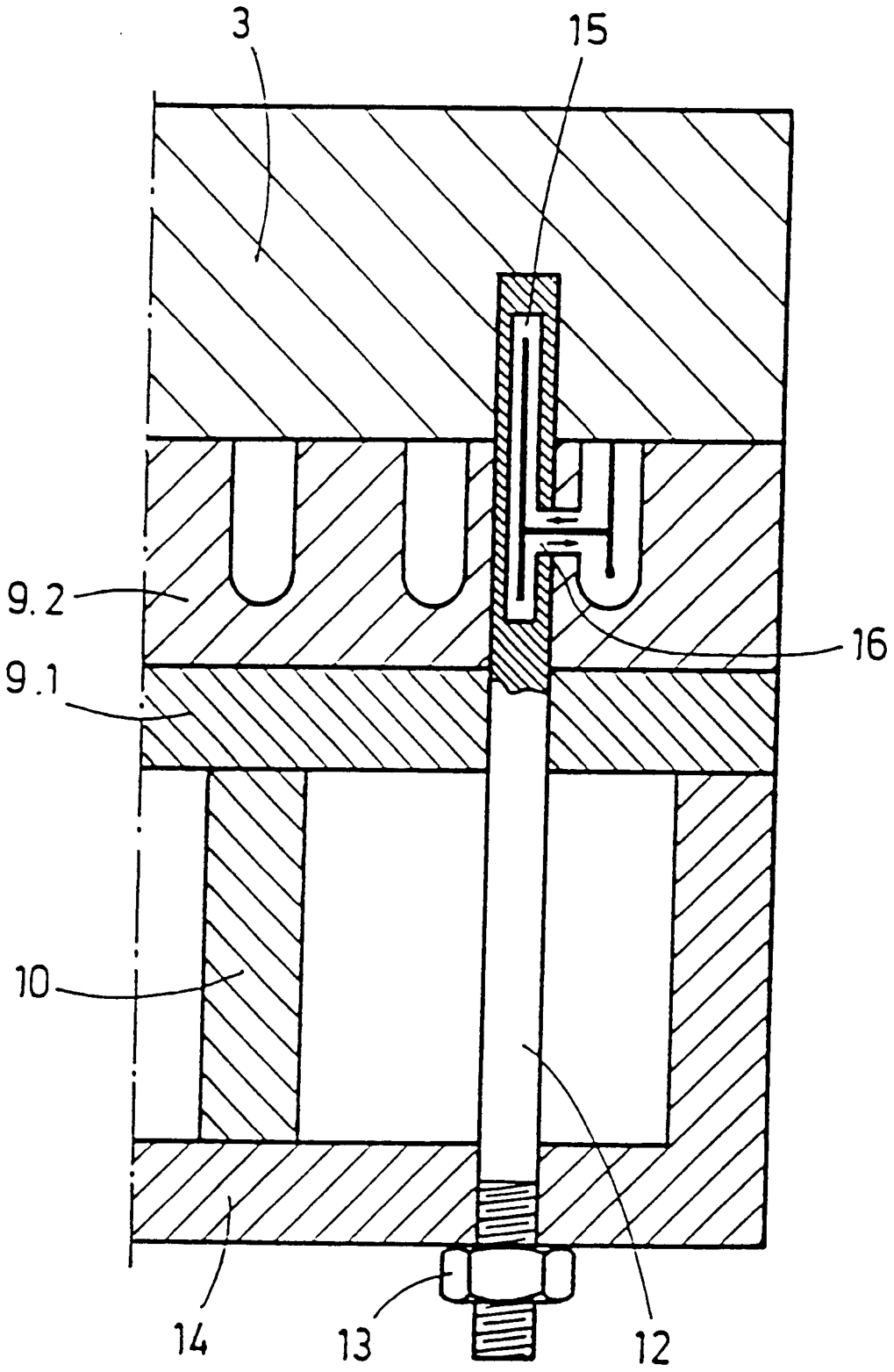
FIG. 3: an enlarged illustration of detail A in FIG. 2.

FIG. 3 shows an enlarged detail A of FIG. 2 with a cooling connection 16 to the water conduits 7 and with a cooling duct 15 arranged in the connecting screw 12, wherein the conduits 7 and the duct 15 are only schematically illustrated and the detailed configurations can be easily carried out by those skilled in the art.

Consequently, the invention has an unexpected, multiplying, positive effect on the strand quality, the mold durability and the operating costs.

What is claimed is:

1. A continuous casting mold for casting strands, preferably of steel, the continuous casting mold comprising mold plates and water boxes, and a connecting plate for connecting each mold plate to one of the water boxes, wherein a water cooling system is formed by means of water conduits between the mold plates and the water boxes, wherein the water conduits are arranged in a side of the water box facing the mold plate and not in the mold plate, wherein the water box and the connecting plate of the water box are joined together by means of connecting screws and nuts, wherein the connecting screws are arranged in the mold plate and the nuts are arranged on the water box, wherein the connecting screws comprise internal cooling ducts, wherein the internal cooling ducts are connected to the water conduits.

2. The continuous casting mold according to claim 1, wherein a portion of each connecting screw arranged in the mold plate comprises a cooling connection to the water conduits.

3. The continuous casting mold according to claim 1, wherein the mold plate has a surface on a side facing an interior of the mold, and the water box has a surface on a side facing the mold plate, and wherein the surface of the mold plate and the surface of the water box extend parallel to each other in horizontal and vertical directions.

4. The continuous casting mold according to claim 3, wherein the water box has on the side facing the mold plate a metal plate as the connecting plate, and wherein the water conduits are located in the connecting plate.

5. The continuous casting mold according to claim 1, wherein the connecting plate is of copper or a copper alloy.

6. The continuous casting mold according to claim 1, wherein the water box is comprised of a steel construction, wherein the connecting plate is of steel and the water box comprises webs, wherein the connecting plate is welded to the water box at the webs.

7. The continuous casting mold according to claim 6, wherein the connecting plate is of sandwich construction, the sandwich construction comprising an intermediate plate of copper or a copper alloy arranged on a steel plate, and wherein the water conduits are provided in the intermediate plate.

8. The continuous casting mold according to claim 1, wherein a water coverage of the mold plate on a side facing the connecting plate conducting the cooling water is more than 30%, wherein the water conduits have a conduit width, wherein the conduits further have combs having a comb thickness, wherein the water coverage is a ratio of the conduit width to a sum of the comb thickness and the conduit width.

* * * * *